US005477691A

United States Patent [19]

White

[11] Patent Number: 5,477,691

[45] Date of Patent: Dec. 26, 1995

[54] LIQUID CRYOGEN DELIVERY SYSTEM

[75] Inventor: Norman H. White, East Amherst, N.Y.

[73] Assignee: Praxair Technology, Inc., Danbury, Conn.

[21] Appl. No.: 312,921

[22] Filed: Sep. 30, 1994

[51] Int. Cl.[6] ..... F25B 19/00

[52] U.S. Cl. ..... 62/50.2; 62/50.1; 62/50.4; 62/113

[58] Field of Search ..... 62/50.1, 50.2, 62/50.4, 113

[56] References Cited

U.S. PATENT DOCUMENTS

| | | | |
|---|---|---|---|
| 3,440,829 | 4/1969 | Davies-White | 62/50.1 |
| 3,572,047 | 3/1971 | Hatfield | 62/50.1 |
| 3,754,407 | 8/1973 | Tyree, Jr. | 62/50.1 |
| 4,296,610 | 10/1981 | Davis . | |
| 4,464,904 | 8/1984 | Steigman . | |
| 4,715,187 | 12/1987 | Starns | 62/50.1 |
| 4,741,166 | 5/1988 | Jensen et al. | 62/50.1 X |
| 4,852,358 | 8/1989 | Acharya et al. | 62/63 |
| 4,856,285 | 8/1989 | Acharya et al. | 62/63 |
| 5,079,925 | 1/1992 | Maric | 62/49.1 |
| 5,161,381 | 11/1992 | Victor et al. | 62/37 |
| 5,214,925 | 6/1993 | Hoy et al. | 62/50.1 X |
| 5,325,894 | 7/1994 | Kooy et al. | 62/50.2 X |
| 5,392,608 | 2/1995 | Lee | 62/50.2 X |

*Primary Examiner*—Christopher Kilner
*Attorney, Agent, or Firm*—Stanely Ktorides

[57] ABSTRACT

A liquid cryogen delivery system for providing liquid cryogen to a use point, such as a freezer, at a constant temperature employing a subcooler for use disposed between the cryogen source and use point wherein expanding fluid flows countercurrently and annularly to the cryogen in a controlled manner responsive to pressure differences between the liquid and a reference pressure.

8 Claims, 4 Drawing Sheets

LIQUID CRYOGEN DELIVERY SYSTEM

FIELD OF THE INVENTION

This invention relates to apparatus for delivering a liquid cryogen to use a point such as a refrigeration unit or a pumping system and, more particularly, to a system which assures that the delivered cryogen reaches the use point at a predetermined temperature.

BACKGROUND OF THE INVENTION

FIG. 1 illustrates a conventional refrigeration system 10 (i.e. a freezer) typical of a use point to which the invention may be applied. A conveyor belt 12 is included on which material 13 to be refrigerated is transported. Conveyor belt 12 is positioned within freezer compartment 14 and has a variable speed drive that is user-controllable. A liquid cryogen (e.g., nitrogen) is sprayed onto product 13 through a number of nozzles mounted on manifolds 16 positioned along the path of belt 12 which in the example illustrated in FIG. 1, is moving from right to left. Sufficient nitrogen is sprayed into freezer compartment 14 to hold the temperature therein at a set point, using a temperature controller and control valve. Fans 18 are placed throughout freezer compartment 14 to circulate the gas atmosphere. A vent fan 20 discharges the nitrogen gas outside of the building.

The temperature of product 13 is typically measured every 30 minutes to assure that it falls within an acceptable range. After the periodic reading is taken, the internal freezer temperature, and sometimes the speed of belt 12, are adjusted in an attempt to hold product 13 within a preset temperature range. Typical residence times in freezer compartment 14 are from 3 to 30 minutes and the time to measure delivered product temperature is 10 or more minutes. Therefore, any change made to the internal temperature within freezer compartment 14 is based on conditions that existed some 13 to 40 minutes previously. For these reasons, it is necessary to hold the operating parameters within freezer compartment 14 as constant as possible. Those parameters include:

(1) condition and temperature of the inlet liquid nitrogen (2) temperature of the incoming product 13;

(3) spacing of product 13 on the belt 12;

(4) speed of circulating fans 18;

(5) speed of belt 12; and (6) discharge rate of vent fan 20.

With the exception of the temperature of the inlet liquid nitrogen, all of these parameters are within the control of the operator. Thus, it is important that the refrigeration system include a means for controlling the cryogenic liquid nitrogen introduced into freezer compartment 14.

Liquid nitrogen is typically piped to freezer compartment 14 at temperatures between −301° F. and −309° F. which represents a three percent variation in refrigeration value. Liquid nitrogen droplets that are sprayed on the product furiously boil in flight, cooling the bulk of the droplets to −320° F. Gas generated in this cooling process emerges at −320° F. and becomes component A of the freezer atmosphere as shown in FIG. 1. The remaining portion of the liquid nitrogen droplet lands on the product and continues to boil, resulting in a high heat transfer rate. Gas generated in this boiling process also emerges at −320° F. and becomes component B of the freezer atmosphere. The last component (C) of the freezer atmosphere is air-infiltration from the freezer input and output openings. Fans 18 enhance forced convection heat transfer from product 13 and have their speeds set as high as possible to achieve maximum heat transfer rates, but below a speed that will blow product 13 off belt 12.

Because the temperature within the freezer compartment is related to convection heat transfer, as the incoming nitrogen temperature increases, more nitrogen has to be boiled to cool itself and less is available to refrigerate the product. However, the total cold gas volume and temperature available for forced convection remains constant.

In FIG. 2, a spray bar 30 is illustrated that includes a pair of manifolds 32 which communicate with a plurality of nozzles 34. Liquid nitrogen is introduced into manifolds 32 via inlet 35 and exits through nozzles 34 towards product 13 on belt 12 as illustrated in FIG. 1. Typically, thirty or more nozzles 34 are used to spread the spray area across the width of belt 12. Because heat transfer in this area represents at least half of the total refrigeration, it is imperative that liquid nitrogen output from nozzles 34 be maintained constant and continuous.

In FIG. 3, a plot of flow from nozzles 34 versus distance along spray bar 30 illustrates that the nozzles closer to inlet 35 produce larger flow rates than nozzles near the extremities of manifolds 32. A number of factors affect the relative discharge rate at each of nozzles 34. Manifolds 32 are exposed to the freezer atmosphere and heat is transferred to the liquid nitrogen at a fairly constant rate per unit length along manifolds 32 As a result, the temperature of the liquid nitrogen increases as it travels through manifolds 32. The temperature rise is exacerbated by the fact that liquid flow is less in each segment of manifolds 32 between successive nozzles. Therefore, heat absorbed per pound of nitrogen is geometrically higher in each successive segment. As a result, the temperature and vapor pressure also increases geometrically at each nozzle Further, liquid delivered from each nozzle 34 is inversely proportional to the heat content of the nitrogen at inlet 35.

The result of the above factors on distribution of flow from nozzles 34 is shown in the chart of FIG. 4 which plots flow against nozzle position along manifolds 32. Curve 40 plots the fall-off in flow at a vapor pressure of 15; curve 42 at a vapor pressure of 17; and curve 44 at a vapor pressure of 19. As is known to those skilled in the art, a higher vapor pressure is illustrative of a higher temperature nitrogen. Note that curve 44 shows that nozzle F in FIG. 2 is completely shut off from flow as a result of the increased temperature of the nitrogen. Thus a relatively small change in vapor pressure at inlet 35 effectively shuts off nozzle F and possibly further nozzles that reside closer toward inlet 35. If the vapor pressure (i.e., temperature) of nitrogen entering inlet 35 can be maintained at a constant level, appropriate spray patterns can be maintained along the entire length of manifolds 32. However, liquid nitrogen that is supplied from a reservoir tank exhibits temperature variations that occur (1) as a result of variables within the reservoir tank and (2) as a result of losses which occur in piping between the reservoir and the spray bar so In practice, vapor pressure of incoming liquid nitrogen from a reservoir tank will have significant variation in its vapor pressure.

The prior art has attempted to overcome the vapor pressure variation through the use of a "programmed blow-down " and subsequent pressure build-up within the reservoir tank. The blow-down causes a pressure reduction in the tank, enabling an uppermost layer of the liquid nitrogen to boil and absorb heat from the body of the liquid. The blow-down process is inefficient in that gas phase contents are lost and the walls of the tank that are wetted by the gas are cooled down to saturation temperature during the venting process. The walls are then reheated in the pressure rebuilding process consuming additional liquid product.

Subcoolers of various types have been proposed for use in cryogenic freezing operations to achieve temperature control. A subcooler is a temperature reduction/vapor condensing means which delivers a liquid cryogen at its outlet in a subcooled liquid state, i.e., at a pressure higher than its equilibrium vapor pressure at the temperature at which the cryogen exits from the subcooler. U.S. Pat. Nos. 4,296,610 to Davis and 5,079,925 to Maric both disclose prior art subcooler devices. Such subcoolers have a number of limitations. Typically, conventional subcooler designs do not provide a means to closely control the outlet nitrogen temperature and, furthermore, do not provide enough capacity for ordinary freezing operations. Moreover, such subcoolers have generally been set up as independent structures and include complicated piping and tankage.

Accordingly, it is an object of this invention to provide an improved system wherein cryogen may be provided to a use point or consumption means and wherein the cryogen temperature at an outlet is maintained at a constant temperature.

It is another object of this invention to provide an improved subcooler which enables temperature control of a main cryogen feed so as to achieve a constant temperature outlet.

It is yet another object of this invention to provide an improved product refrigeration system wherein a constant inlet cryogen feed is provided to enable efficient refrigeration.

SUMMARY OF THE INVENTION

A cryogenic refrigeration system includes a reservoir for a cryogenic liquid and spray bars for providing a shower of cryogenic liquid onto a product to be refrigerated. A supply conduit connects the reservoir to the spray bars and has an interior channel for transporting the cryogenic liquid. A subcooler conduit of larger cross section than the supply conduit is positioned to encompass the supply conduit over a substantial portion of its length so as to create a flow region therebetween. A vent connects the flow region to an area of low pressure relative to the pressure in the supply conduit. A valve connects the flow region and the interior channel of the supply conduit and enables a controlled flow of cryogenic liquid/vapor from the supply conduit into the flow region. A valve controller is connected to the valve and is responsive to a pressure difference between the vapor pressure of the interior channel contents and a reference pressure to control the valve to alter the flow of cryogenic liquid through the flow region and the vent. A resulting expansion of the cryogenic liquid in the flow region subcools the cryogenic liquid in the supply conduit and creates a constant temperature cryogen at the outlet.

DETAILED DESCRIPTION OF THE INVENTION

Figure 1:
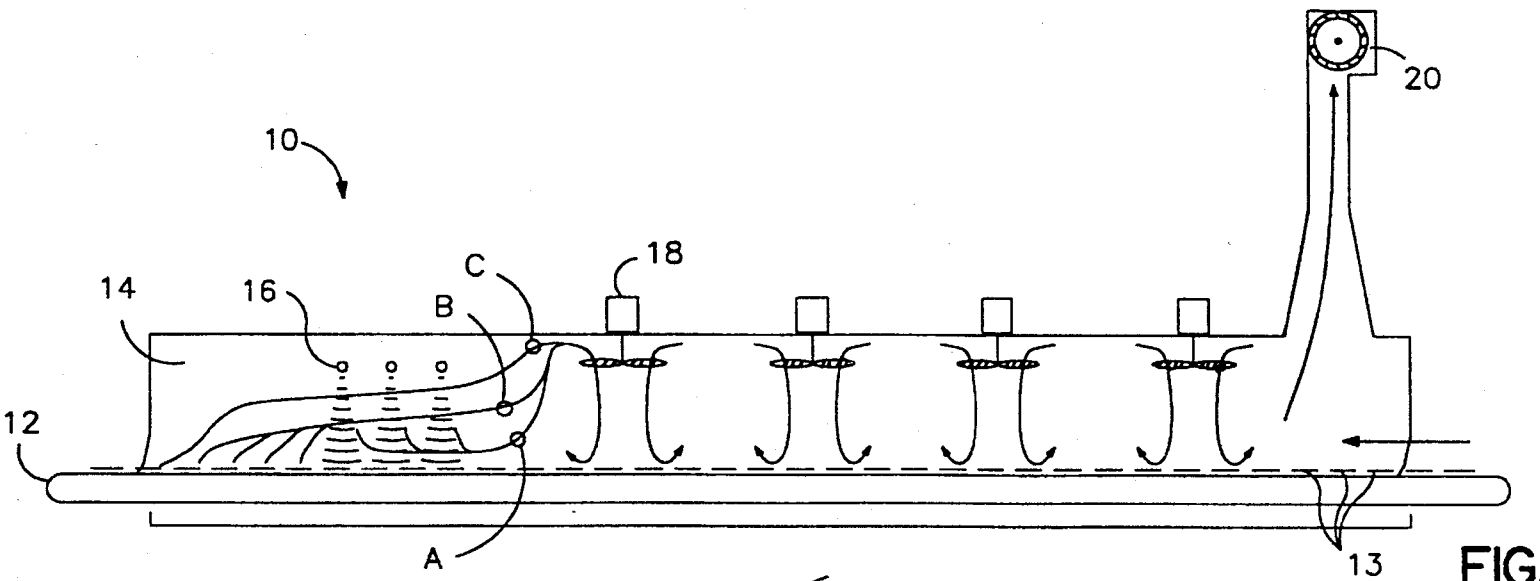
FIG. 1 (PRIOR ART)
FIG. 1 is a schematic view of a typical cryogenic refrigeration system.
Figure 2:
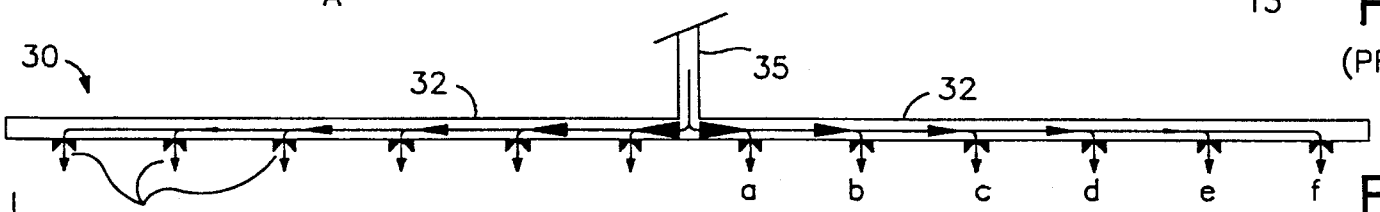
FIG. 2 (PRIOR ART)
FIG. 2 is a schematic view of a typical spray bar employed in the refrigeration system of FIG. 1.
Figure 3:
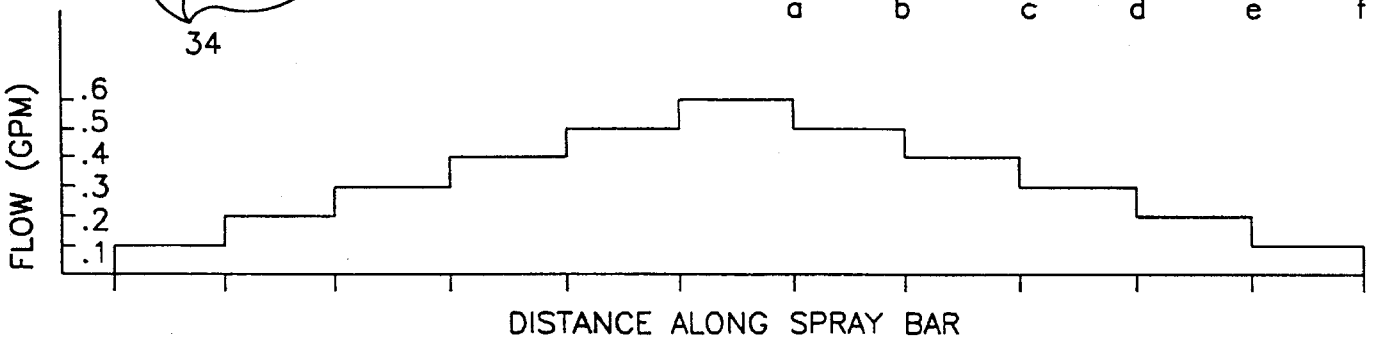
FIG. 3 (PRIOR ART)
FIG. 3 is a plot of flow versus distance along the spray bar of FIG. 2, illustrating a variation in flow rates through nozzles positioned along the spray bar.
Figure 4:
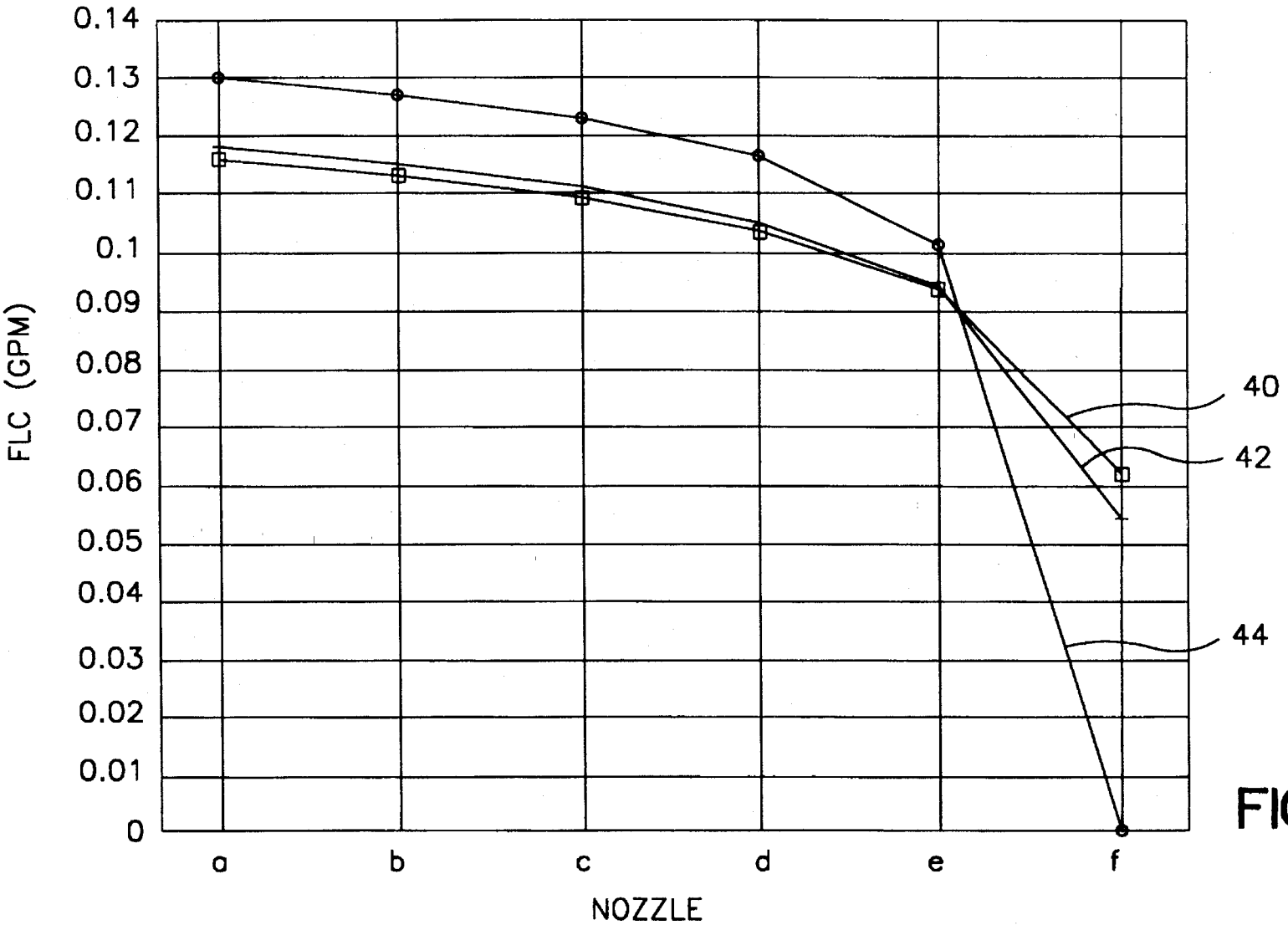
FIG. 4 is a plot of nozzle position versus flow rate and indicates the affect of vapor pressure changes on nozzle flow rates.
Figure 5:
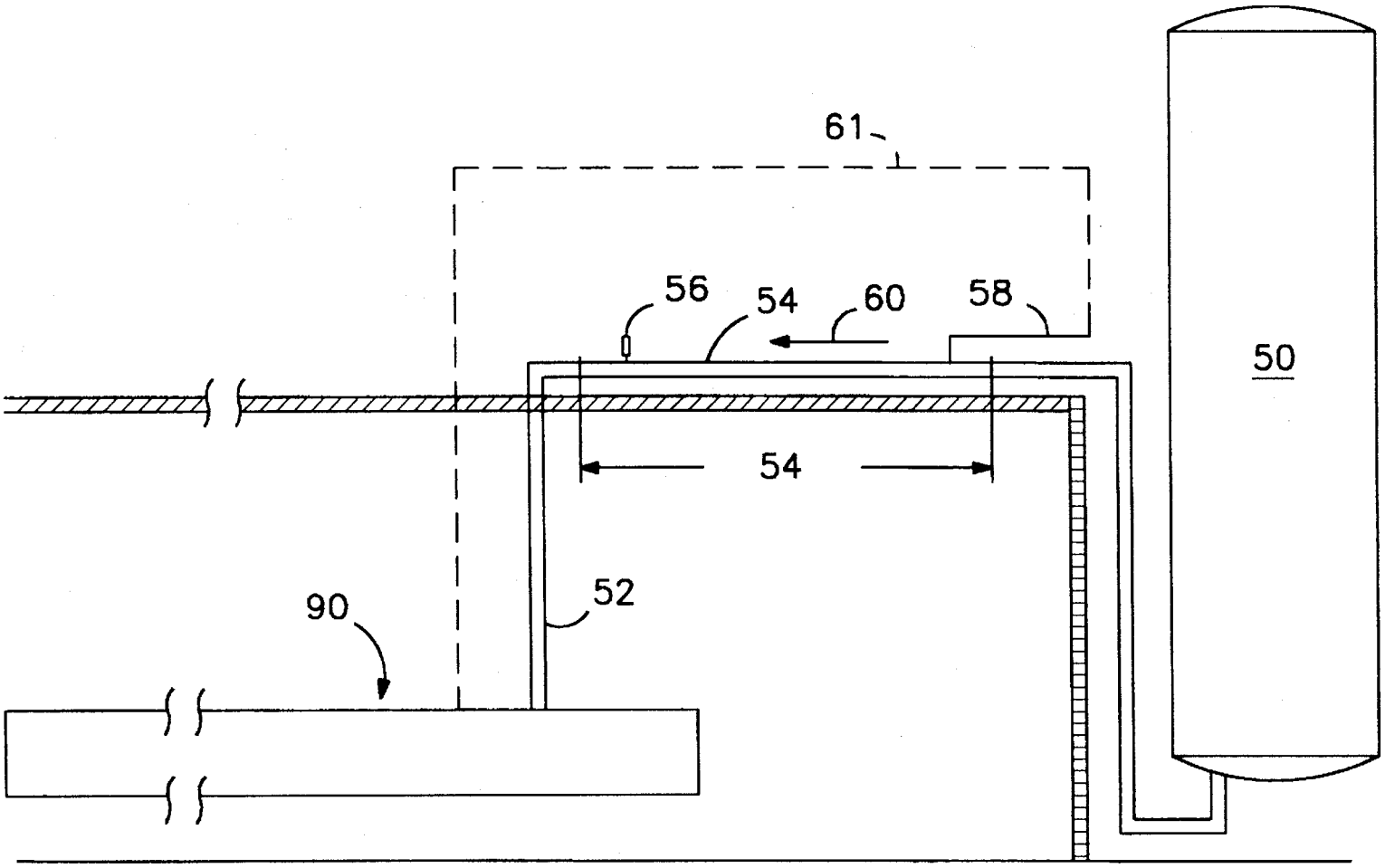
FIG. 5 is a schematic view of one embodiment of the invention showing the positioning of an in-line subcooler between a cryogen tank and a refrigeration system.

Referring to FIG. 5, a cryogen-containing tank 50 is connected by a conduit 52 (i.e., a pipe) to refrigeration unit 90 which may be similar to unit 10 illustrated in FIG. 1. Hereafter, the cryogen will be referred to as nitrogen, but those skilled in the art will realize that the invention is usable with any cryogen (i.e., liquified argon, oxygen, hydrogen etc., and liquified gas mixtures such as natural gas, air etc.). To maintain an inflow of liquid nitrogen into refrigeration unit 90 at a constant temperature, an in-line subcooler 54 is positioned about pipe 52. At the liquid nitrogen exit of subcooler 54, a control valve 56 is positioned. At the liquid nitrogen inlet of subcooler 54 is positioned a vent pipe 58 that communicates with the atmosphere.

Subcooler 54 comprises an internal conduit which carries liquid nitrogen in the direction indicated by arrow 60. A larger diameter conduit encircles the inner conduit and includes subcooler control valve 56, which enables communication between the liquid nitrogen flowing in direction 60, and an annulus which surrounds the inner conduit and extends back towards vent 58. Through Controlled operation of valve 56, based upon the temperature of the out-flow liquid nitrogen, certain of the liquid nitrogen is vented into the annulus surrounding the inner supply conduit and passes in a countercurrent direction towards vent pipe 58. The substantial expansion which occurs as a result of this venting action controls the temperature of the liquid nitrogen flowing in direction 60, and enables the liquid nitrogen out-flow from subcooler 54 to be maintained at a constant temperature.

The annulus is maintained at approximately 0 pounds per square inch gauge (PSIG) compared to the inner supply conduit which may be at 30 to 40 PSIG. In general cryogens may exist over a range of temperature. Associated with each temperature is a vapor pressure which is the minimum pressure required to maintain the liquid phase and which increases with increasing temperature. When the pressure is reduced below the vapor pressure, a portion of the liquid boils, absorbing sensible heat from the remaining body of liquid and thereby reducing its temperature. Therefore, when the liquid is vented from the 30 to 40 PSIG in the inner supply conduit to the annulus which is maintained at near 0 PSIG, a portion of the liquid must boil absorbing sensible heat from the remaining body of liquid and thereby reducing its temperature. For example, the temperature of liquid entering the subcooler, for example at 30 PSIG and 88.4 K., will be reduced to 77.4 K. when vented to atmospheric pressure, i.e. 0 PSIG.

Figure 6:
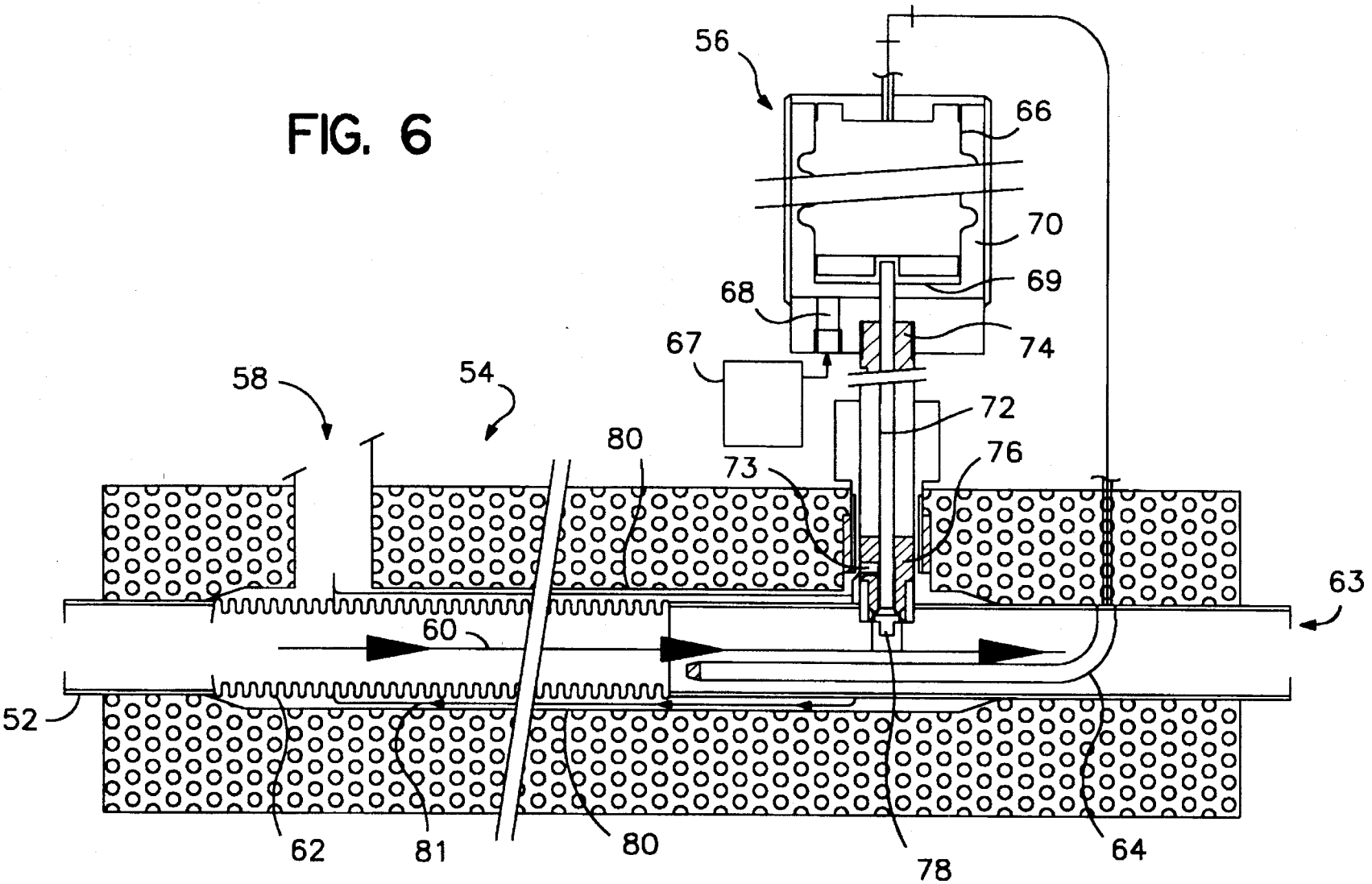
FIG. 6 is a sectional view illustrating one embodiment of the subcooler useful in the practice of this invention.

Turning to FIG. 6, details of subcooler 54 will be described. The numerals in FIG. 6 correspond to those of FIG. 5 for the common elements. However, the subcooler illustrated in FIG. 6 is illustrated as positioned in the opposite direction as that illustrated in FIG. 5. For purposes of this discussion it is assumed that the liquid nitrogen inflow temperature is −301° F. Pipe 52 carries the liquid nitrogen through subcooler 54 and, in the subcooling region, is configured as a metal bellows 62 for improved heat transfer. At outflow end 63, subcooler control valve 56 is positioned and operates under control of a vapor bulb 64. Vapor bulb 64 contains a gas which communicates with the interior of a bellows 66 that is internal to subcooler control valve 56. A reference pressure source 67 is connected to valve inlet 68 and communicates with enclosed region 70 that surrounds the external portion of bellows 66. The bottom surface 69 of bellows 66 is connected to a valve actuating shaft 72, which moves vertically in upper and lower shaft guides 74 and 76. A valve member 78 rests against a seat at the bottom of shaft guide 76 and when impelled in a downward direction, opens an annulus about shaft 72 which enables flow of nitrogen up about the circumference of shaft 72, out a horizontally disposed valve exit 73 and into an annular flow region 80 surrounding pipe 52. Nitrogen introduced into annular flow region 80 flows in a direction that is counter to the flow of nitrogen in pipe 52, as indicated by arrows 81, and is vented to the atmosphere through vent 58. The resulting expansion of the nitrogen in annular flow region 80 subcools the nitrogen flowing in pipe 52.

Control of valve member 78 is achieved by operation of vapor bulb 64 in combination with reference pressure source 67. Assuming nitrogen inflow at −301° F. (vapor pressure 29.7 PSIG) and a desired outflow nitrogen temperature of −309° F. (vapor pressure 14.5 PSIG), reference pressure 67 is set to the desired outlet vapor pressure of 14.5 PSIG. When the outlet nitrogen temperature is above −309° F. and the corresponding vapor pressure is above 14.5 PSIG, the vapor pressure within vapor bulb 64 acts against the reference pressure region 70 of valve 56, causing the bellows to expand, due to relatively higher pressure therein and to push shaft 72 in a downward direction. As a result, valve member 78 moves downwardly, opening the annulus about shaft 72 and enabling escape of nitrogen through the annulus and passage 73 into subcooler annular flow region 80. The liquid nitrogen introduced into the reduced pressure of annular flow region 80 (which is at atmospheric pressure) boils furiously, extracting heat both from itself and the liquid nitrogen flowing in pipe 52.

The expansion of the bellows is proportional to the difference in pressure between the inside and the outside of the bellows. For this reason, the opening of valve member 78 and therefore the amount of liquid nitrogen admitted to the annulus is proportional to the difference between the vapor pressure of the outlet fluid relative to the reference pressure. The flow of nitrogen into the annulus is thereby regulated so that the desired outlet vapor pressure is maintained.

As a result, a constant flow of liquid nitrogen at −309° F. is achieved as an inflow to the spray bars within refrigeration unit 90. Thus, determined amounts of liquid nitrogen flow from nozzles, such as nozzles 34 illustrated in FIG. 1, enabling continuous controlled refrigeration of product. The reverse flow cooling liquid in annular flow region 80 is a flowing stream rather than a stagnant pool, as in conventional systems, enabling improved heat transfer. Because the liquid nitrogen stream in annulus 80 flows countercurrent to the cryogen flow, the vented gas is actually superheated so that approximately 5 percent less gas is vented in the cooling process than with conventional designs. Further, the vented gas may be piped to refrigeration unit 90 (shown in FIG. 5 in phantom by pipe 61) to utilize all of the available refrigeration.

The configuration of in-line subcooler 54 enables substantial heat transfer with little pressure drop and is packaged in such a manner that little additional space is required. Furthermore, the control mechanism is compact and substantially self-contained. Subcooler control valves of the type shown in FIG. 6 can achieve control accuracy to within ±0.5° F. of the desired temperature which enables an extremely accurate inflow temperature of the liquid nitrogen to refrigeration unit 10. The subcooler can be sized for a wide range of conditions. Inlet temperatures may approach critical temperature and outlet temperatures may approach the temperature of that of the cryogen associated with a vapor pressure of 0 PSIG. The flow rate of product through the subcooler also may vary over a range of 20 or more to 1. The subcooler can be used to control inlet temperatures to pumps, refrigerators or analytical instruments. The apparatus can further be sized for a wide range of flow rates ranging from of 0.1 GPM to 250 GPM (gallons per minute).

It should be understood that the foregoing description is only illustrative of the invention. Various alternatives and modifications can be devised by those skilled in the art without departing from the invention. For example, while an application of the invention to a refrigeration system has been described, it may be applied to any system wherein an introduction of a liquid cryogen at a constant temperature is required. Accordingly, the present invention is intended to embrace all such alternatives, modifications and variances which fall within the scope of the appended claims.

What is claimed is:

1. A cryogenic consumption system comprising:

a reservoir for a cryogenic liquid;

consumption means for employing said cryogenic liquid;

supply conduit means connecting said reservoir to said consumption means and having a supply channel for transporting said cryogenic liquid under an elevated supply pressure;

subcooler conduit means positioned to encompass said supply conduit means over a substantial portion of a length thereof and creating a flow region therebetween;

vent means located at an inflow region of said supply conduit means connecting said flow region to a space of lower pressure than said supply pressure;

valve means located at an outflow region of said supply conduit means connecting said flow region and said supply channel of said supply conduit means, for enabling a controlled flow of said cryogenic liquid from said supply channel into said flow region, cryogenic liquid passing from said elevated supply pressure to said space of lower pressure in said flow region being caused to expand and cool cryogenic liquid in said supply channel; and control means connected to said valve means and responsive to a manifestation of a temperature variation of said cryogenic liquid in said supply channel to control said valve means to alter a flow of cryogenic liquid through said flow region so as to maintain said cryogenic liquid at a constant outflow temperature.

2. The cryogenic consumption system as recited in claim 1 wherein flow of said cryogenic liquid into said flow region passes from said valve means to said vent means in a manner which is countercurrent to flow of said cryogenic liquid in said supply conduit means.

3. The cryogenic consumption system as recited in claim 1 wherein said control means and valve means comprise:

a movable bellows;

enclosure means surrounding said bellows;

means for applying a reference pressure in a region between said enclosure means and said bellows;

a valve connected to said bellows and positioned within an orifice connecting said supply channel and said flow region, for controlling flow of said cryogenic liquid from said supply channel into said flow region; and means for controlling a pressure state within said bellows, said pressure state dependent upon a temperature of said cryogenic liquid in said supply channel.

4. The cryogenic consumption system as recited in claim 3 wherein said means for controlling comprises:

a vapor pressure bulb positioned in communication with said cryogenic liquid in said supply channel, said vapor pressure bulb containing a gaseous charge of said cryogenic liquid that is in direct gaseous communication with an interior region of said bellows, whereby a change of vapor pressure of such charge in response to a temperature variation of said cryogenic liquid causes expansion or contraction of said bellows working against said reference pressure.

5. An in-line subcooler comprising:

supply conduit means having a supply channel for transporting a cryogenic liquid to an outlet under an elevated supply pressure;

subcooler conduit means positioned to encompass said supply conduit means over a substantial portion of a length thereof and creating a flow region therebetween;

vent means located at an inflow region of said supply conduit means connecting said flow region to an area of lower pressure than said supply pressure;

valve means located at an outflow region of said supply conduit means connecting said flow region and said supply channel of said supply conduit means, for enabling a controlled flow of said cryogenic liquid from said supply channel into said flow region, cryogenic liquid passing from said elevated supply pressure to said lower pressure being caused to expand and cool cryogenic liquid in said supply channel; and control means connected to said valve means and responsive to a manifestation of a temperature variation of said cryogenic liquid at said outlet, to control said valve means to alter a flow of cryogenic liquid through said flow region so as to maintain said cryogenic liquid at a constant outflow temperature.

6. The in-line subcooler as recited in claim 5 wherein flow of said cryogenic liquid into said flow region passes from said valve means to said vent means in a manner which is countercurrent to flow of said cryogenic liquid in said supply channel.

7. The in-line subcooler as recited in claim 6 wherein said control means and valve means comprise:

a movable bellows;

enclosure means surrounding said bellows;

means for applying a reference pressure in a region between said enclosure means and said bellows;

a valve connected to said bellows and positioned within an orifice connecting said supply channel and said flow region, for controlling flow of said cryogenic liquid from said supply channel into said flow region; and means for controlling a pressure state within said bellows, said pressure state dependent upon a temperature of said cryogenic liquid in said supply channel.

8. The in-line subcooler as recited in claim 7 wherein said means for controlling comprises:

a vapor pressure bulb positioned in communication with said cryogenic liquid in said supply channel, said vapor pressure bulb containing a gaseous charge of said cryogenic liquid in direct gaseous communication with an interior region of said bellows, whereby a change of vapor pressure of said charge, in response to a temperature variation of said cryogenic liquid causes expansion or contraction of said bellows working against said reference pressure.

* * * * *